US005112209A

United States Patent [19]

Ahrweiler et al.

[11] Patent Number: 5,112,209

[45] Date of Patent: May 12, 1992

[54] TWIN-BELT PRESS FOR MANUFACTURING PARTICLE BOARDS

[75] Inventors: Karl-Heinz Ahrweiler, Willich; Bernd Heimes, Monchengladbach, both of Fed. Rep. of Germany

[73] Assignee: Eduard Küsters Maschinenfabrik GmbH & Co KG, Krefeld, Fed. Rep. of Germany

[21] Appl. No.: 466,309

[22] PCT Filed: Sep. 30, 1988

[86] PCT No.: PCT/DE88/00602

§ 371 Date: Apr. 5, 1990

§ 102(e) Date: Apr. 5, 1990

[87] PCT Pub. No.: WO89/03288

PCT Pub. Date: Apr. 20, 1989

[30] Foreign Application Priority Data

Oct. 9, 1987 [DE] Fed. Rep. of Germany ..... 3734180

[51] Int. Cl.[5] ..... B27N 3/24; B30B 5/06

[52] U.S. Cl. ..... 425/371; 100/93 RP; 100/151; 100/152; 100/154; 156/583.5; 425/409

[58] Field of Search ..... 100/93 RP, 151-154; 156/555, 583.1, 583.5; 425/193, 335, 371, 372, 406, 409; 264/109

[56] References Cited

U.S. PATENT DOCUMENTS

| | | | |
|---|---|---|---|
| 2,993,527 | 7/1961 | Moser et al. | 156/555 |
| 3,795,470 | 3/1974 | De Mets | 264/109 |
| 3,851,685 | 12/1974 | Ahrweiler et al. | 100/93 RP |
| 3,885,901 | 5/1975 | Reiners | 425/371 |
| 3,929,065 | 12/1975 | Csordas et al. | 100/154 |
| 4,647,417 | 3/1987 | Bottger et al. | 100/154 |
| 4,718,843 | 1/1988 | Carlsson et al. | 100/154 |
| 4,744,854 | 5/1988 | Schenz | 156/583.5 |

FOREIGN PATENT DOCUMENTS

| | | | |
|---|---|---|---|
| 920934 | 2/1973 | Canada | 156/583.5 |
| 144163 | 6/1985 | European Pat. Off. . | |
| 1009797 | 6/1957 | Fed. Rep. of Germany . | |
| 1084014 | 6/1960 | Fed. Rep. of Germany . | |
| 2329600 | 1/1975 | Fed. Rep. of Germany . | |
| 2448794 | 5/1975 | Fed. Rep. of Germany . | |
| 2404523 | 8/1975 | Fed. Rep. of Germany . | |
| 2419706 | 11/1975 | Fed. Rep. of Germany . | |
| 2157746 | 10/1978 | Fed. Rep. of Germany . | |
| 2343427 | 4/1981 | Fed. Rep. of Germany . | |
| 3133792 | 7/1985 | Fed. Rep. of Germany . | |
| 3538531 | 5/1987 | Fed. Rep. of Germany . | |
| 2139811 | 1/1973 | France . | |
| 2217151 | 9/1974 | France . | |

*Primary Examiner*—Richard L. Chiesa
*Assistant Examiner*—James P. Mackey
*Attorney, Agent, or Firm*—Kenyon & Kenyon

[57] ABSTRACT

In a double-band or similar press the pressure on the mat that is being fed in is increased so rapidly as soon as this mat comes into contact with the heat-transfer surfaces that the outer areas of the mat harden under the great pressure, whereas the heat has still not penetrated into the interior of the mat. This results in an enhancement of the surface quality of the panel. As an example, to this end, a roller gap can be provided before the feed gap.

13 Claims, 5 Drawing Sheets

400
2
8
9
1
4
3
5
38
50

2,5
S2
S1
2,5
2,5
42
6
7
43
2,5
6'
7'

20
S2
S1
20
44
25
25
42
6
7
90
6"
7'
37

TWIN-BELT PRESS FOR MANUFACTURING PARTICLE BOARDS

BACKGROUND OF THE INVENTION

The present invention relates to double-band press for the continuous production of wood-chip boards and similar board materials.

The wood particles are flat chips, as well as other particles produced by the reduction of wood, e.g., by planing, chopping, sawing, grinding, or disintegration (Zerfasern—Tr.) that are combined with a binding agent in the form of a thermal hardening plastic resin and scattered or spread so as to form a mat or a fleece. The mat is compressed between the surfaces to form a panel-like or similar shaped part, whereby the surfaces are heated and heat flows from the surfaces into the mat so as to increase the temperature, harden the bonding agent, and consolidate the mat to form a compact panel or the like. In a multi-stage press the "surfaces" are the pressure panels or plates and in a double-band press they are both the bands. In place of flat surfaces, as in the cases quoted above, presses with a large drum and a steel band that passes around this are used to produce thin panels.

During the production of wood-chip panels and similar materials, the pressure and temperature curves at the initial phase of compression are extremely important for the properties of the finished panel. In conventional continuous presses, this compression takes place in the area of the feed gap of the supporting structure, and it is already known that the feed gap can be made adjustable and the adjustment can be controlled depending on the type of production (DE-PS 31 33 792, DE-AS 23 43 427) in order that the formation of the panel characteristics can be influenced in an appropriate manner.

The plastification that the wood fibres or chips undergo during the combined effect of pressure, heat, and the moisture which is present in the mat, which is carefully controlled, plays a very important part in the way that the product turns out.

DE-OS 35 38 531, which deals with the so-called calendering press of this kind, with a heated pressure drum that is enclosed about a portion of its periphery by a steel band that passes over guide and pressure rollers, describes the fleece at the start of the compression gap is compressed to a value that lies in the range above or below the normal thickness of the finished panel and is then heated while contained between heated pressure drums and the steel band during simultaneous forward movement until such time as the particles enter their plastic state and the bonding agent has been brought to the required hardening temperature. These measures are intended to achieve a good panel surface during a single pressing operation and at the same time achieve better thermal transfer in the layer of chips because of the increased density at the start of the compression, as well as a more rapid penetration of the heat into the outer areas of the compressed chip layer. DE-OS 35 38 531 does not provide details about the management of pressure and temperature.

It is the task of the present invention to so configure this type of process and the appropriate pressing such that in particular the surface quality of the wood chip and similar panels produced thereby is enhanced, so that they can be used in the furniture industry without any surface smoothing possibly for the rear walls of cabinets and the bottoms of drawers, and are also suitable for lacquering, and as a basis for laminates.

SUMMARY OF THE INVENTION

The features of the present invention interact so that the mat that is combined with the bonding agent is compressed very rapidly during the action of the curing temperature that is transferred from the surfaces onto the outer layers of the mat, this happening so rapidly that the inner zones of the mat still have not been heated to elevated temperatures by the time compression has been completed. Thus, the outer layers have already become plastic and flexible and conform to the surfaces during compression and the formation of a smooth outer surface, whereas the inner zones still have not become plastic and exert a corresponding high resistance to compression. Thus, during the compression, the outer layers are subjected to a peak pressure that is higher than if the mat were at a high temperature throughout and were then compressed to the same end thickness. Thus, the compression must be achieved before the inner zone of the mat is brought up to temperature. The plastification and hardening that take place initially increase not only the smoothness, but also the hardness and the tensile strength of the top surface layer. During the continued effects of pressure and heat, the heat penetrates into the inner zone, where it results in the plastification of the wood particles. Since the calibre, i.e., the distance between the surfaces is essentially maintained there is no continuing densification inside the mat; here, the mat hardens at an essentially constant lower density. Thus, what results is not a continuously and maximally compacted panel, but a panel in which at least one side, normally however both sides, has an extremely dense( smooth and strong surface layer, whereas the inside is of a somewhat looser structure, so that a type of sandwich effect that leads to extremely stiff panels is achieved, these panels requiring no further work on the surface, which is most desirable in the furniture industry.

A preferred area of application for the invention is in so-called MDF (medium density fibreboard) panels, i.e., fibre panels that are from 2.5 to 5 mm thick, with a specific weight of 600–900 kg/m$^3$, which are used for the purposes set out above.

Since the thermal transfer from the "surfaces" into the outermost layers of the mat is a problem involving movement, this requires a certain amount of time. For this reason, the time between reaching curing temperature in the outer layers to reaching the highest level of compression, which in the main corresponds to the end thickness of the panels, is of decisive importance for the invention.

It has been shown that this time must amount to approximately 0.1 to 2 seconds in order to arrive at the desired panel structure, and in the case of thin MDF panels, this time must amount to 0.15 to 0.5 seconds.

If the invention is used on a double-band press, the machine-section length that corresponds to the above time and within which the highest compression has to be reached, depends on the throughput speed of the bands, which in individual cases can vary greatly, for example, 30 m/min in the case of panels that are 3 mm thick, and 10 m/min in the case of panels that are 16 mm thick.

According to the present invention the compression of the mat should be effected in one pass within the above short period of time until, for all practical purposes, the end thickness of the panel is reached. The densification (compression) that is to be achieved when this is done has a ratio of 1-5 to 1-7. In most instances, in the case of wood-chip panels and similar materials, the rule is that the mat should be about six times the thickness of the panel that is to be produced therefrom.

A bonding agent that hardens in 0.1 to 2 seconds is used to ensure that the densification that is achieved by the high initial compression of the surface layers is maintained during the subsequent continuous hardening, and ensures that the surface layers do not stretch and lose their high density if the plastification affects the deeper areas.

The present invention is embodied in an apparatus that is suitable for carrying out the process described heretofore, namely, a double-band press for the continuous production of a continuous flat wood-chip panel belt or web.

The rapid and powerful compression of the mat required by the present invention cannot be achieved by simply feeding in the mat between the bands of a conventional double-band press, as is set out in DE-PS 21 57 746. This press has an adjustable first section of the supporting plate, but if a steep position such as is required to achieve the rapid compression as described in the present invention is set, the forces that are generated are so great as to endanger the press, and the force required to advance the product can no longer be transmitted from the bands, to say nothing of the sharp transition between the steep first part of the pressure plate and the pressure plate in the main compression section, which would destroy the bands.

A double-band press of this kind is known from DE-PS 10 84 014. According to FIG. 5 of DE-PS 10 84 014, three pairs of rollers that are staggered in the direction of movement of the bands are arranged ahead of the feed gap; of these, the outermost is formed by the upper guide drum and a roller that acts from below against this. The three pairs of rollers are intended to compress the mat that is fed in between the bands with a considerable pressure before it is subjected to the effects of heat in the actual compression section. The compression of the mat to essentially the end thickness thus takes place without any simultaneous effect of heat. Thus, the rapid compression according to the present invention during the thermal transfer cannot be achieved with the known apparatus.

Here, the mat comes into contact with the hot bands during its first encounter with the double-band press, and is rapidly compressed only in the outer layers when in contact with the bands and during the transfer of heat in order to achieve the densification of these outer layers, such as is preferred according to the present invention.

A specific duration for the permissible time is 0.1 to 2 seconds.

The pair of rollers may be formed by the upper guide drum and an additional roller that is provided beneath the upper run of the lower band. This results in smaller additional costs since the existing guide drum is used as a roller in the pair of rollers, and simply has to be heated.

Furthermore, the guide drums may be arranged vertically above one another and the roller pair may be formed by the guide drums. This embodiment advantageously incorporates no additional rollers.

In another embodiment, the pair of rollers is additionally provided. The bands travel a certain distance from the guide drums to the rollers that form the roller gap. Even if the guide drums are heated a certain amount of cooling can occur in the bands because of this, especially after contact with the mat, since the thermal capacity of the bands is low.

One or both of the guide drums can be heated in order to transfer heat into the bands in this way.

In some of the embodiments an additional heating system is advantageously provided, by means of which the particular band can be brought to curing temperature, and which can supply heat before the bands with the mat have reached the roller gap. In order to avoid a drop in temperature because of the heat that is absorbed by the outer layers of the mat, the rollers of the pair of rollers can also be heated.

In the conventional versions of double-band presses, the lower band is usually longer than the upper band and projects opposite the direction of movement of the bands, so that the mat can be spread on the projecting portion and only passes beneath the upper guide drum once it has travelled a certain distance, and is then enclosed between both the bands.

If, when the process is carried out in this manner, the lower band is heated on the lower guide drum, the section on which the mat lies on the hot lower band is too long so that it becomes heated right through and the effect that is sought after according to the present invention, of the preferred compression and hardening of the outer layers, does not occur.

In order to avoid this the mat may be moved by the feed system so that it comes into contact with both bands at essentially the same time. This not only helps to achieve the desired enhancement of the surfaces of the panel per se, since no excessively long preheating takes place from below, but the simultaneous formation of the upper and the lower surfaces of the panel becomes possible thereby.

This simultaneous contacting of the mat with both bands can be achieved by means of a tray that first holds the mat away from the band that is moving beneath it, and only permits it to slide onto the lower band at the desired moment.

In order that the position of the points of contact of the mat on the lower or upper band can be adjusted, it is recommended that the front edge of the tray be made adjustable. The compression needed to achieve the desired effect of enhancing the surface layers is considerable and must be achieved as the mat moves a very short distance. The forces that are generated are correspondingly large. The compression process can be enhanced and the particular band can be in part relieved of the tensile forces necessary to overcome the resistance compression if the rollers that form the roller gap are driven.

According to another aspect of the invention there is no roller gap provided at the feed point. The rapid compression during the action of heat, according to the present invention, is ensured by a suitable configuration of the supporting plates that form the feed gap, the bands conforming to the curvature of the supporting plates and diverging from each other at an angle, so that the mat comes into contact with the bands for the first time in the in-feed.

The configuration of the curvature is a compromise between the demands of the process and the technical possibilities of a double-band press. The process requires rapid compression of the mat in order that the preferred densification is achieved in the panel surface.

However, this is counter to the fact that the bands that move the mat through the compression section under compression pressure are subjectd to a considerable longitudinal tension, onto which bending stresses are superimposed when the bands flex. In order that the range of yield stress is not reached, particularly at higher temperatures, there is a lower limit to the permissible radii. A rule of thumb states that for each millimetre of band thickness the smallest radius may not be less than 400 mm. Since the form bands that are used in practice are approximately 1.5 to 2 mm thick, the smallest radius must lie in the range between 600 and 800 mm, which result in the conventionally used diameter of the guide drums of approximately 1500 mm, to which the smallest radius of the curvature should essentially equal.

However, the feed gap does not have to have a purely circular longitudinal section but can be of a form that differs somewhat from a circular shape. What is important is that at no point must the radius be smaller than the permitted minimum, in order that the desired rapid compression can be achieved at a given working speed.

In another configuration the part of the supporting plate that is adjacent to the curve of the feed gap can be pivoted with the curved portion in order to form a variable in-feed. This embodiment is particularly important in practice because it makes it possible to operate using the process according to the present invention as well as in accordance with conventional processes with one and the same machine. If the essentially flat part of the supporting plate is adjusted so as to be parallel or essentially parallel to the opposite supporting plate, the rapid compression takes place in the area of the curved portion and this calibre is maintained subsequently as is desired in the already described manner during the production of thin MDF panels with smooth and especially tension-proof surface layers. If, however, the essentially flat part of the pivoting supporting plate is pivoted, so that, together with the opposite supporting plate it forms a feed gap that becomes constantly narrower in the direction of movement, there is no abrupt densification with a subsequently maintained calibre, but a gradual densification as the heating of the inner zones of the mat progresses. In this way, it is possible to produce a panel that has essentially constant characteristics throughout its thickness. Such panels, of a thickness in the order of approximately 20 mm, are used in the furniture industry for the backs of cabinets or for cabinet sides, and frequently undergo subsequent milling operations to produce rabbets or grooves, or decorative surface reliefs. In order that the milled surface displays characteristics that are as far as possible constant, the material must display the same characteristics at all the depths to which such milling is carried out. Here, strictly homogenous properties of the wood-chip panel are required. The double-band press that is discussed herein can satisfy both requirements without the need to undertake any other changes apart from the simple adjustment of the in-feed area. When this is done, the position of the cross shaft can be adjusted vis-a-vis the opposite supporting surface in order to make it possible to adapt the transition to the actual compression section, as may be required.

Double-band presses with variable in-feeds are known from DE-OS 24 48 794, DE-AS 10 09 797, and DE-AS 23 43 427, wherein, in the last case, the supporting plate is to be elastically deformable, in contrast to the present invention. In the last embodiment of a double-band press discussed above, it is also recommended that the form bands be heated ahead of the in-feed between the supporting plates.

If, however, the bands can be heated sufficiently by the guide drums, it may also be necessary to incorporate a heat shield, for example in the area ahead of the in-feed, where the hot band is opposite the unprotected surface of the mat and where, unless precautions are taken, the hardening of the bonding agent could be initiated prematurely.

It is, of course, understood that other features of the double-band press as discussed above, e.g., the feed system that includes the tray, can be used in the present double-band press.

DESCRIPTION OF THE PREFERRED EMBODIMENTS

Figures 1, 2, 3, 4, 5:
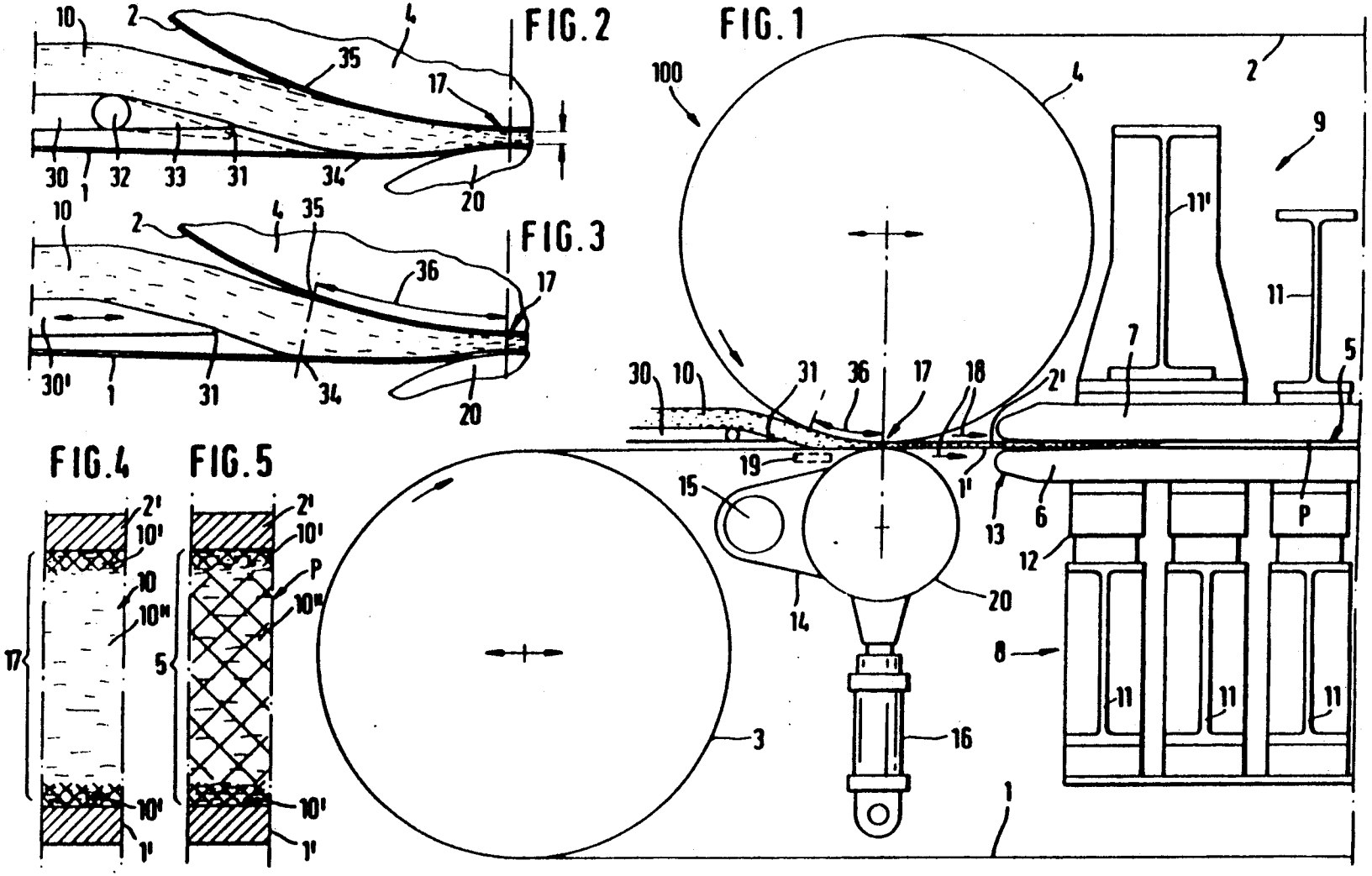
FIG. 1: a vertical partial longitudinal section through the in-feed area of a double-band press according to the present invention.
FIGS. 2 and 3: sections of the compression zone from FIG. 1, at enlarged scale.
FIGS. 4 and 5: partial long sections through the mat or the finished panel web fed in between the bands.

The double-band press shown in FIG. 1 and which bears the overall number 100 includes a lower band 1 and an upper band 2 that are of sheet steel approximately 1.5 mm thick, and which circulate endlessly one above the other in a vertical plane. The bands 1 and 2 are guided over guide drums 3 and 4 that correspond to two further guide drums situated to the right, outside FIG. 1 (not shown herein), the bearing positions of these being variable in the direction shown by the arrows so as to permit adjustment to the tension on the bands. The upper run 1' of the lower band 1 and the lower run 2' of the upper band 2 are separated by a slight distance above one another and form supporting surfaces $S_1$ and $S_2$, between which the mat 10 is compressed in accordance with a specific time program. The bands 1, 2 run in a horizontal compression section that is essentially flat, at equal speed and in the same direction, as indicated by the arrows 18. Within the compression section 5, a mat 10 of wood chips and bonding agent that is located between the runs 1', 2' is exposed to the effects of pressure and heat and hardened so as to form a continuous and coherent panel web P. The bands 1, 2 are driven by the guide drums. The guide drums 3, 4 that are shown are heated and have a surface that is thermally conductive so that heat is transferred to the bands 1, 2. This heating is so calculated that as the bands 1 and 2 pass around the guide drums 3, 4 they reach a temperature that is sufficient to harden the layers of the mat 10, located between the bands 1, 2, that are adjacent to the form bands 1, 2.

Within the compression section 5, beneath the upper run 1' of the band 1 there is a supporting plate and above the lower run 2' of the upper band 2 there is an upper supporting plate 7. Endless roller chains (not shown herein) run in longitudinal channels in the supporting plates 6, 7 and these provide rolling support for the runs 1' 2' of the bands 1, 2 within the compression section 5. The supporting plates 6, 7 are in turn supported on supporting structures that are numbered 8, 9; these supporting structures consist of I-beams 11 that extend transversely across the width of the bands 1, 2 and of which in each instance one is vertically opposite another such beam above or beneath the compression section 5 and which is connected with this at the side, outside the bands 1, 2. Pressure is exerted by means of hydraulic pressure elements 12 that are arranged between the supporting structure 8 and the lower supporting plate 6, by means of which the calibre, which is to say, the distance between the runs 1', 2' in the compression section, can be controlled. The compression section 5 can be 10–20 m long; thus, according to FIG. 1, a number of carrier pairs 11, 11 extend further to the right. At the left end, as in FIG. 1, the supporting plates 6, 7 form a feed gap 13 that grows narrower in the direction of movement of the bands 1, 2.

The two beams 11 of the supporting structure that is the furthest to the left are opposite only one reinforced beam 11' of the supporting structure 9. This is made necessary for structural reasons, in order to have the guide roller 4 as close as possible to the feed gap 13.

The guide roller 3 is also as close as possible to the feed gap 13. The distance from the feed gap 13 is, however, somewhat greater, because vertically beneath the guide roller 4, between the guide roller 3 and the feed gap 13, there is another roller 20 that is supported at the ends on rockers 14 so as to be able to pivot up and down about a cross shaft 15 and which can be pressed from below against the guide roller 4 by a hydraulic cylinder 16 so as to form an inter-roller gap 17.

The mat 10 is not, as is usually the case, laid down by the spreader system onto the upper run 1' of the lower band 1, which would then have to be much further to the left. The formation of the mat takes place differently; the mat 10 is moved over a tray 30 that extends in the direction of movement 18 towards the roller gap 17 until it is beneath the guide drum 4. The mat 10 slides from the tray 30 over the front edge 31 of the tray and onto the run 1' of the lower band 1 and then is carried on this in the direction of movement 18 into the roller gap 17.

The transition and intake zone is shown at a larger scale in FIG. 2. The front edge 31 of the tray 30 is formed by a blade-like hinged plate 33, that can pivot at the end that is remote from the knife edge front edge 31 about a cross shaft 32. In the position of the front edge 31 that is shown by the solid line in FIG. 2, the under side of the mat comes into contact with the hot lower band 1 at point 34, whereas the upper side of the mat 10 comes into contact with the upper band 2 that passes around the heated guide roller 4 at point 35. The points 34 and 35 are thus those locations at which the outermost layers of the mat 10 are subjected to the curing temperature.

In the embodiment shown, the points 34, 35 are not on the same level. By pivoting the hinged plate 33 downwards into the position shown by the dashed line the mat 10 is lowered earlier so that the point 34 is displaced to the left and the point 35 is displaced to the right; thus, the position of the contact points can be changed thereby. If the panel that is to be produced from the mat 10 is to be identically configured on both sides, steps are taken to ensure that the points 34, 35 are at about the same height, viewed in the direction of movement of the mat 10.

FIG. 3 shows a tray 30', the front edge 31 of which can be adjusted by movement as indicated by the arrow. In the embodiment shown, the points of contact 34, 35 between the mat 10 and the hot bands 1, 2 are at approximately the same level.

Important for the present invention is the fact that the maximum compression within the roller gap 17 is achieved the points 34, 35 in 1–5 seconds.

In a specific embodiment, the diameter of the guide drum 4 is approximately 150 cm, and the distance shown in FIG. 3 from the area of the contact points 34, 35 through the apex of the roller gap is approximately 25 cm. At a working speed of the double-band press 100 of 5 m/min will take 2.5 seconds to pass through the section 36.

It is clear that if the points 34, 35 are not at the same height, the point that is furthest removed from the apex of the roller gap 17 (35 in FIG. 2) must satisfy the condition that the running time should amount to 1–5 seconds. If the running time in contact with a hot band is too great, heating will take place right through the mat and the effect shown in FIG. 4 will not be achieved.

FIG. 4 illustrates the situation in the roller gap 17. The mat 10 has been in contact with the runs 1', 2' of the bands 1 and 2 for a brief period of 1–5 seconds and has been greatly compressed within the roller gap 17, whereas the heat transferred from the runs 1', 2' has only penetrated into the outermost layers 10', and the centre zone 10'' of the mat 10 is still cold. Thus it offers far greater resistance to compression than the chips in the outer layers 10' that are already plastic, and will be greatly compressed, which fact is indicated by the greater density of the strokes in zone 10' that represent the chips. Simultaneously, however, the bonding agent is cured by the elevated temperature in the zones 10', and this fact is represented by the cross-hatching in the drawing.

In this state, i.e., with compressed and bonded outer layers 10' and an unbonded inner zone 10'', the mat 10 passes between the runs 1' and 2' into the feed gap 13 and into the compression section 5, where it is exposed for a longer period to the effects of pressure and heat, which leads to the fact that the heat penetrates right into the innermost zone 10'', where hardening also takes place, which is indicated schematically by the somewhat coarser cross-hatching in FIG. 5.

Although preferred, it is not necessary that the improvement of the surface quality is achieved on both sides of the panel P. If, for example, in the first instance, the upper side of the mat 10 is to be compressed as shown in FIG. 1, the lower guide drum 3 need not be heated. If, however, both sides are to be treated the same and the guide drum 3 is thus heated, the band 1 may have already lost temperature on the section from the upper side of the guide drum 3 to the point 34. In order to make up this temperature loss and also to supply heat to the run 1' of the band 1, which is at a disadvantage because of its lower thermal capacity, it is possible to provide supplementary heating beneath the run 1', just before the roller gap 17; this supplementary heating system can be in the form of induction heating, for example.

In FIGS. 6 to 10, functionally identical parts bear the same reference numbers.

Figure 6:
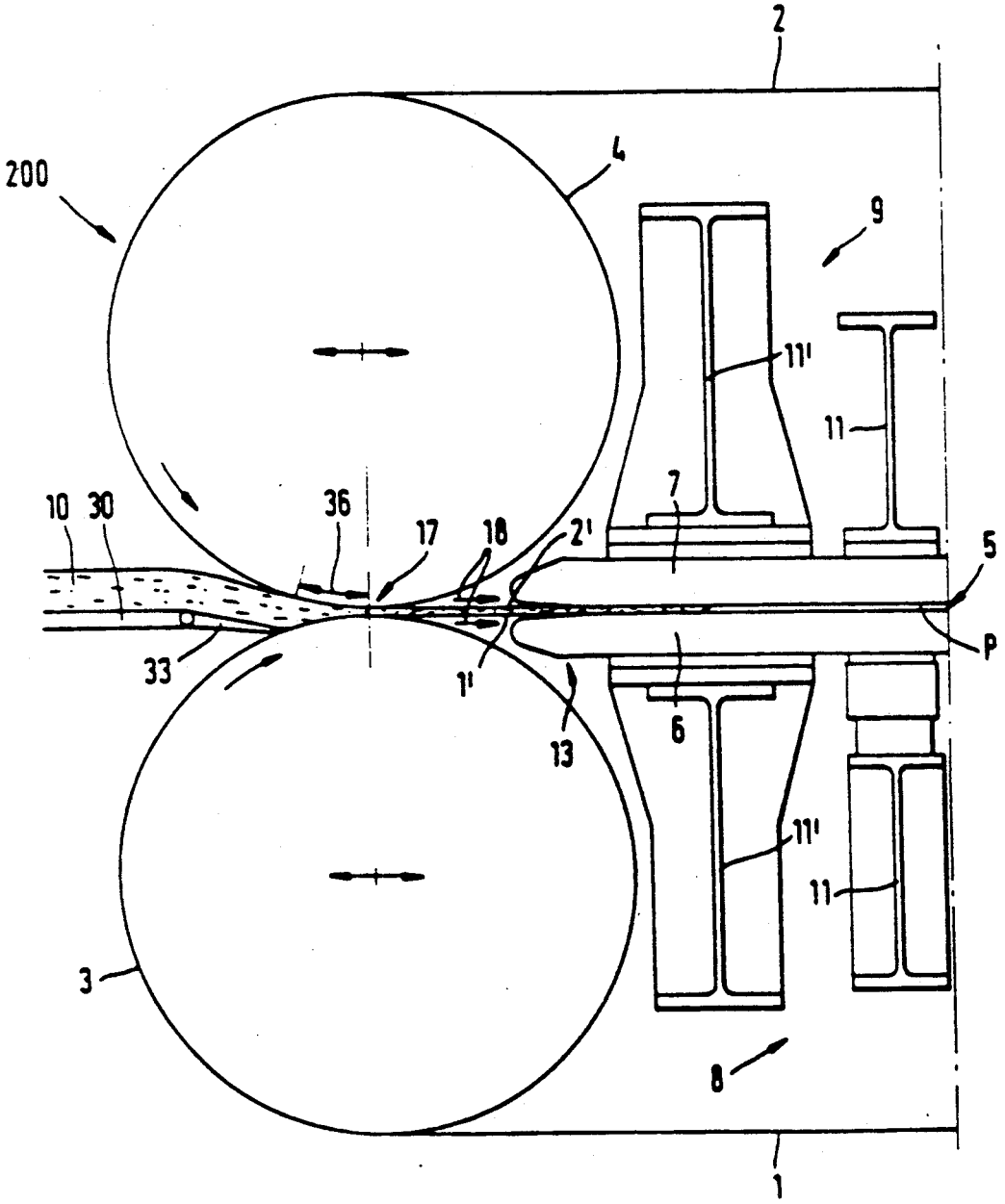
FIGS. 6 and 7: views of two further embodiments of a double-band press according to the present invention, these corresponding to FIG. 1.

In the double-band press 200 shown in FIG. 6, no additional rollers are needed to form the roller gap 17. Here, the guide drums 3, 4 are arranged with their shafts one above the other in a vertical transverse plane and form the roller gap 17 thereby. Since, in this case, the guide drums 3, 4 are as close as possible to the feed gap 13, two reinforced beams 11' are opposite each other at the left-hand end of the supporting structures 8 and 9 in FIG. 6; these correspond to the beams 11' in FIG. 1 and are cut back in the feed direction of the double-band press 200 in the area of the "equator" of the guide drums 3 and 4, and become wider again towards their respective bases.

For the remainder, the processes in the gap 17 are the same as those that have been illustrated in connection with FIGS. 1 to 5.

Figure 7:
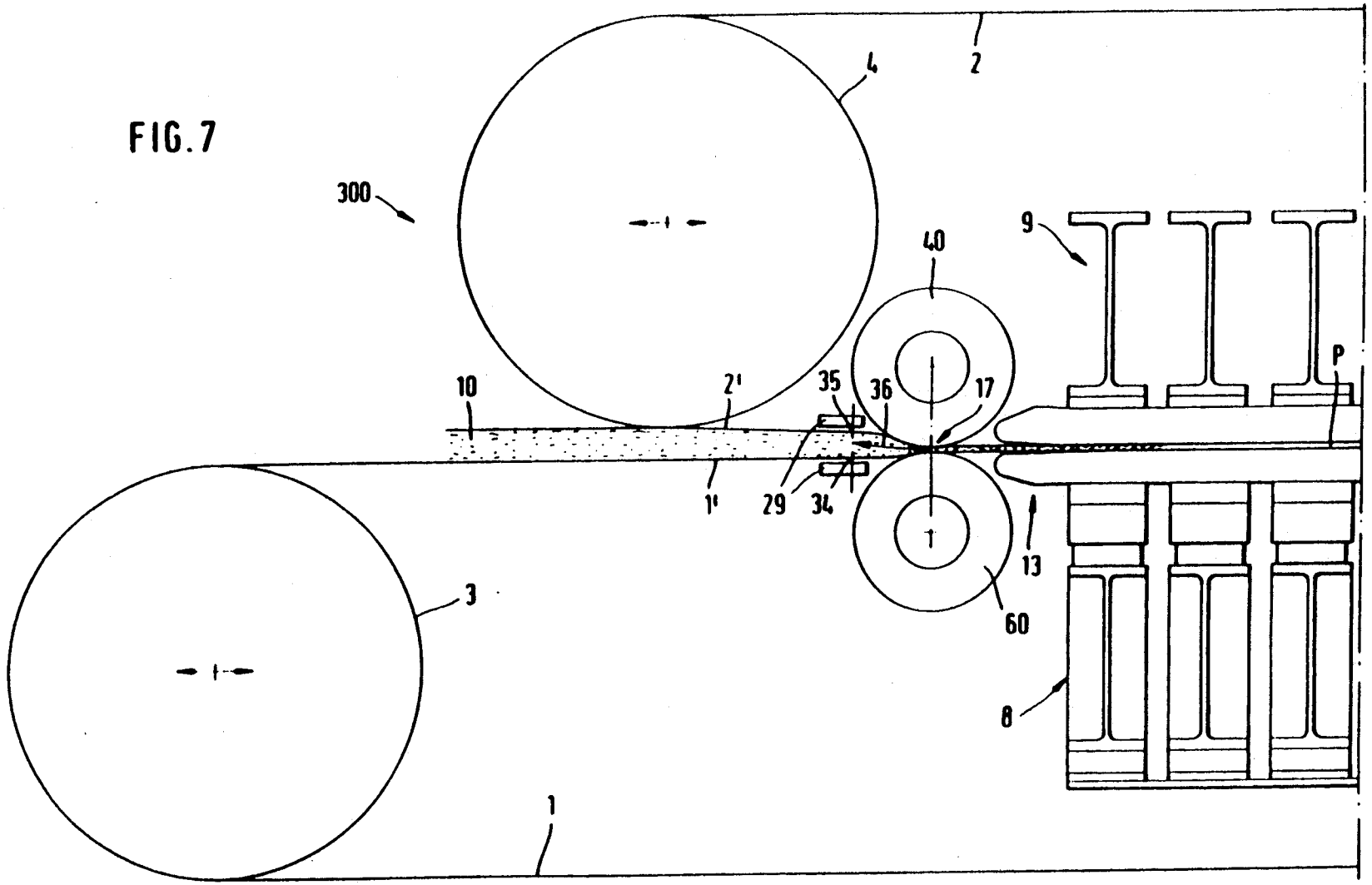

In the double-band press 300 that is shown in FIG. 7, the two guide drums 4 are not a component element of the roller pair that forms the roller gap 17. A separate pair of rollers 40, 60 is provided, the rollers of which act from the outside against the runs 2', 1' and form the roller gap 17. In this embodiment, the runs 1', 2' of the bands 1, 2 are in contact with the mat 10 over a longer section before the roller gap 17 is reached. In order that the desired rapid temperature increase can be achieved, the thermal transfer is effected here not by heating the guide drums 3, 4 but by heating elements 29 that are arranged immediately ahead of the roller gap 17, outside the runs 1', 2' and these heat the bands to the curing temperature. The points 34, 35 at which the mat is exposed to the curing temperature thus lie in the area of the heating elements 29, and the distance 36 which is to be traversed within a period of 1–5 seconds, is to be measured from the heating elements 29 to the apex of the roller gap 17.

The rollers 20, 40, 60 can be of controlled deflection in order to achieve even compression across the width of the mat 10.

Figure 9:
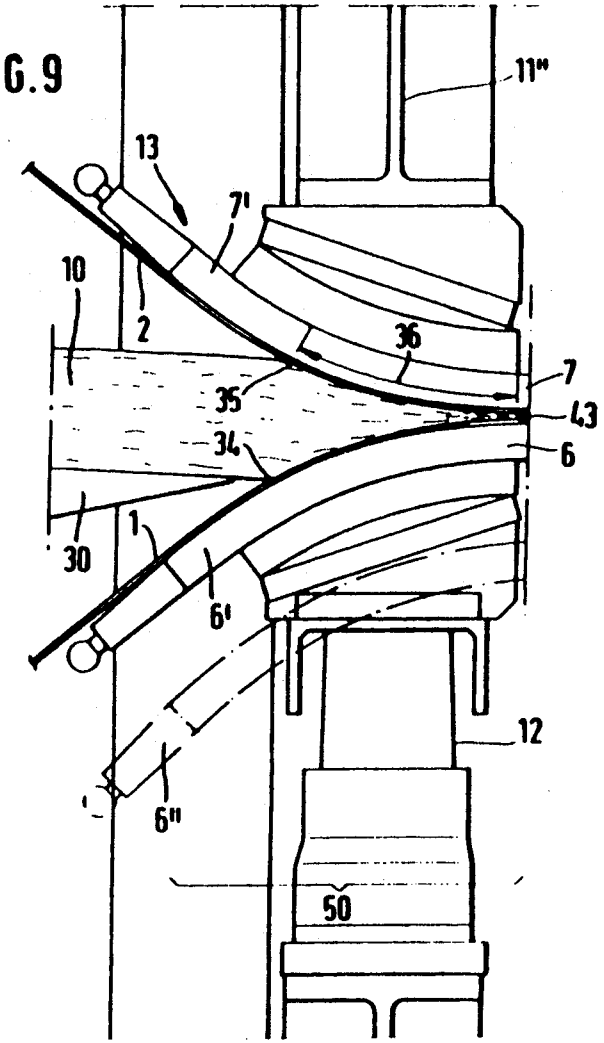
FIG. 9: an enlarged diagram of the area indicated by the dashed line in FIG. 8.

In the double-band press 400 there is no roller gap 17 as is seen in the embodiments 100, 200, 300. Here, this is more of a fundamentally normal double-band press. The actual compression section 5 in which the bands 1, 2 are essentially parallel, is preceded by a feed section 37 that is much shorter than the compression section 5 and which, in the embodiment shown, includes a section 38 with flat supporting plates 6, 7 that extend across the length of six supporting pairs 11, 11' and a preceding feed-in section 50 that extends only across the length of one supporting pair 11'', 11'', and in which the supporting plates 6, 7 curve away from each other, so that the outermost, i.e., in FIG. 8, the left-hand, ends of the parts 6', 7' that curve convexly against the mat 10 as it enters the feed gap 13 subtend an angle of approximately 40° with the plane of the mat 10. In the embodiment shown, the curved parts 6', 7' are curved equally towards the mat 10, i.e., they form a part of a cylindrical surface with a radius that corresponds approximately to the radius of the guide drums 3 or 4, respectively. The supporting plates 6, 6' or 7, 7' are made in one piece or else are connected to each other so as to form a rigid unit. The bands 1, 2 do not run parallel, but are sloped from above and below into the feed gap 13 and then, from them ends of the curved sections 6', 7' of the supporting plates 6, 7 they gradually approach these, so that they are in thermal contact with the heated supporting plates 6, 6' or 7, 7' from the start and are already at the required temperature when they come into contact with the mat 10, as is the case at the points 34, 35 (FIG. 9).

Figure 8:
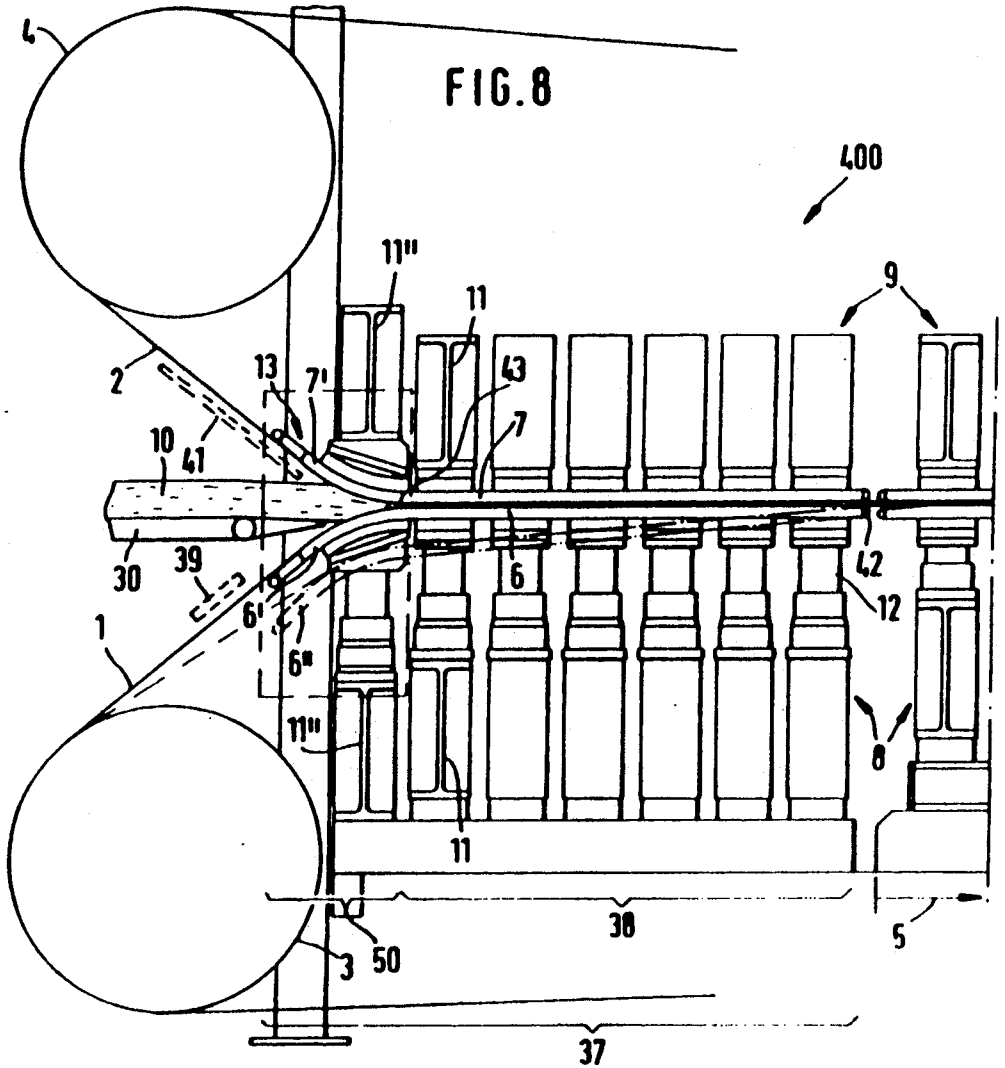
FIG. 8: a view of a fourth embodiment of a double-band press according to the present invention, this corresponding to FIG. 1.

In order to provide additional heating for the bands 1, 2, before they come into contact with the mat 10, additional heating elements 39 can be provided in this embodiment, too, as is indicated by the dashed lines in FIG. 8. In the same way, it is possible to heat the guide drums 3, 4. If the guide drum 4 is to be the sole source of heat for the band 2 and the band 2 is heated to a correspondingly high temperature, a heat shield 41 can be installed above the incoming area of the mat 10, in order that the upper surface of the mat 10 is not prematurely heated by the heat radiated from the band 2 to a temperature at which hardening begins.

In the double-band press 400, too, the distance 36 between the point of first contact with the hot bands 1, 2 and the point 41 of maximum compression is so short that it can be traversed in 0.1 to 2 seconds so that the configuration of the panel that has been described in connection with FIGS. 4 and 5 will take place. At point 43 the in-feed section 50 merges steadily into the section 38, in which the supporting plates 6, 7 are essentially flat.

As is indicated by the dashed lines in FIG. 8, the lower supporting plate 6, 6' can be pivoted, as a rigid unit, downwards away from the upper supporting plate 7, 7' by a few degrees, about a cross shaft 42 that is located at the end of the section 38 that is proximate to the compression section 5 (i.e., in FIG. 8, at the right-hand end). This takes place by the appropriate operation of the pressure elements 12. The transverse shaft 42 does not necessarily have to be formed by a transverse journal that is attached to the supporting plate 6, 6', but can be an imaginary shaft. The inclined position of the supporting plate 6, 6' results from adjustment of the pressure elements 12. By this means it is also possible to displace the cross shaft 42 somewhat further down from the upper supporting plate 7, 7' (as in FIG. 8) which then results in a feed-in area 37 that can be adjusted not only for angle but also for inside width. It is, of course, understood that in place of the lower supporting plate 6, 6' the upper plate 7, 7' can also be pivoted and that both supporting plates 6, 6' and 7, 7' can be pivotable.

Figures 10, 10A, 10B:
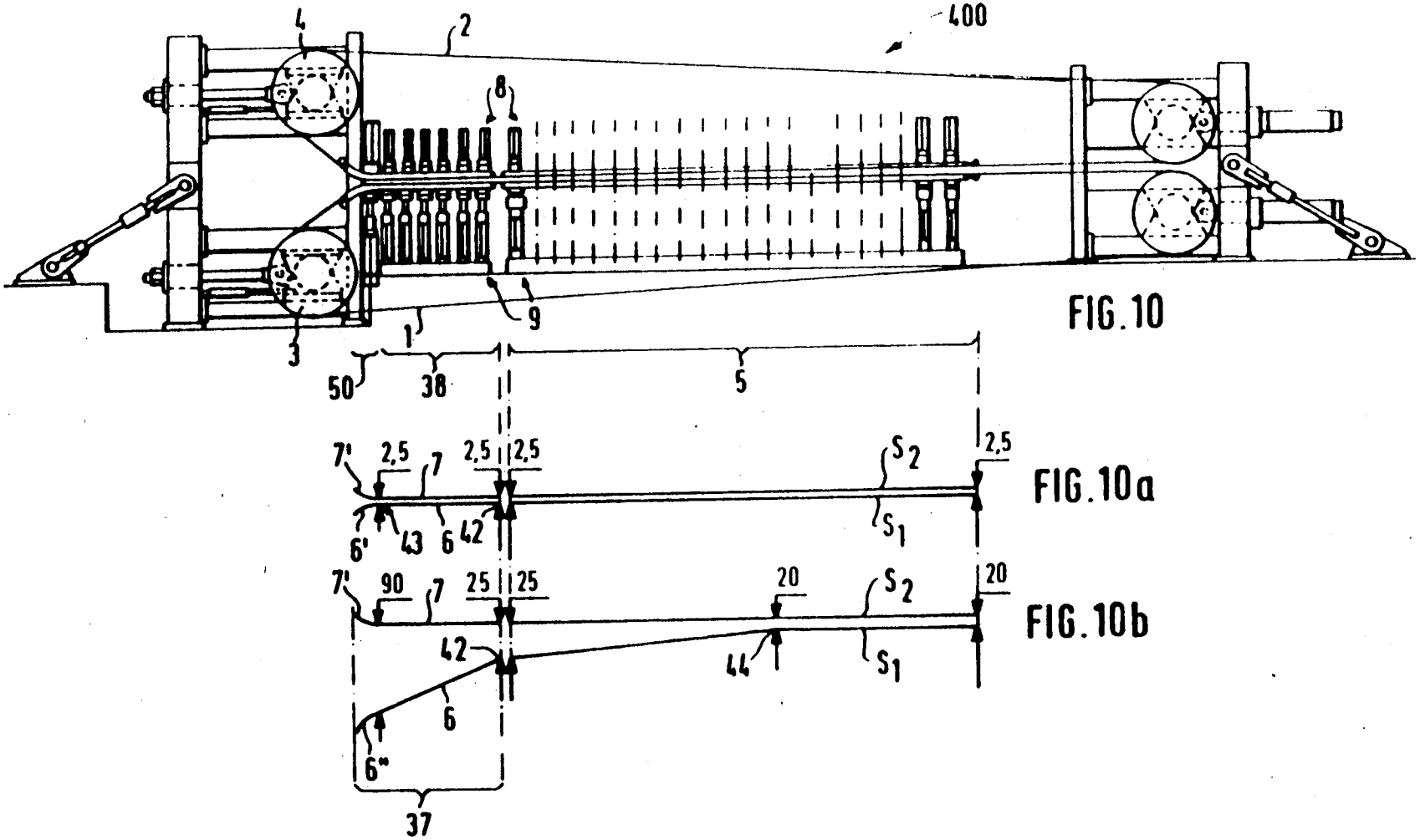
FIG. 10: a side view of the press.
FIGS. 10*a* and 10*b*: the changes in the calibre that result from various settings of the press.

The importance of this design is explained once more on the basis of FIGS. 10, 10*a*, and 10*b*. The overall view in FIG. 10 shows tghe convex curved feed-in section 50, the adjacent flat section 38, and the actual compression section 5, which is also essentially flat.

FIGS. 10*a* and 10*b* show the course of the supporting surfaces through the whole of the double-band press 400.

If medium density fibre panels, 2.5 to 5 mm thick, and having a specific weight of 600–900 kg/m$^3$, of the sort used for the rear walls of cabinets and for the bottoms of drawers, are to be produced on the double-band press 400, and if these are to have a particularly strengthened and smooth surface layer, then the supporting plate 6, 6' is adjusted as in FIG. 10*a* so that the supporting plate 7 is parallel to it in the section 38. The rapid compression ends at point 43, at the end of the in-feed section, at which the in-feed section 50 makes a transition to become the section 38. From there on, the calibre is essentially maintained, i.e., the supporting surfaces $S_1$, $S_2$ lie spaced apart and parallel to each other at a distance that corresponds to the end thickness. In the embodiment shown in FIG. 10*a* what is involved is the production of a thin panel, 2.5 mm thick. The calibre "2.5? is maintained from point 43 to the end of the compression section 5, as is shown by the corresponding figure in FIG. 10*a*.

If, however, as is shown in the embodiment in FIG. 10*b*, a panel that is 20 mm thick is to be produced, within which there is the most homogenous possible structure throughout the thickness of the panel, then the lower supporting plate 6 is tilted somewhat and moved away from the supporting panel 7, 7' so as to form a path in which, at the start of the supporting plate 7 there is a distance of 90 mm between the supporting plates 6, 7, and at the end of the supporting plate 7 there is a distance of 25 mm between the supporting plates 6 and 7. Suitable operation of the pressure element in the compression section 5 will result in a wedge-shaped path in the first half of the compression section 5 up to approximately the point 44, with the initial width corresponding to the width at the end of the supporting plate 7. From point 44 to the right-hand end (in the drawing) of the compression section 5, the distance between the supporting surfaces $S_1$, $S_2$ remains constant.

With the machine adjusted in this way the compression is not ended equally to the start, as is the case at point 43 with the adjustment as in FIG. 10*a*, but takes place slower up to the point 44 within the compression section 5. This means that the wood particles are heated right into the interior of the mat, and this results in more even compression and hardening throughout the thickness of the panel, without any peaks in density or tensile strength.

We claim:

1. A double-band press for the continuous production of wood-chip boards and similar board materials from panel materials consisting of wood-particles held together by a binding agent that is curable under heat and pressure, said press comprising:

two metallic form bands heated to an elevated temperature, each having upper and lower runs; means for continuously circulating said form bands about upper and lower guide drums at substantially the same speed so that the form bands advance within a substantially flat compression section from a feed-in section, said compression section being adapted to compress a mat formed from the particles between the two form bands in a feed gap under the influence of pressure and heat;

a feeding device conveying the mat to the feed gap between the form bands, said feeding device having a feed tray on which the mat is introduced between the form bands, said feed tray extending away from the flat compression section from a position closely above a portion of the feed-in section of the upper run of a lower of said form bands that is in the vicinity of the upper guide drum;

an upper support structure having an upper support plate and a lower support structure having a lower support plate, each of said support structures supporting one of said form bands and transferring heat and pressure thereto, each of said support plates having a zone forming the feed-in section; and an initial feeder segment disposed at an end of said feed-in section remote from said compression section, said initial feeder segment formed by corresponding portions of each support plate to convey the mat through the feed-in section to the flat compression section, at least one of the corresponding portions having a curvature that is convex relative to the other corresponding portion in the vertical, longitudinal plane of the double-band press, and said form band supported on said convex corresponding portion conforms to the curvature thereof, said convex corresponding portion of the support plate having a length beginning at a first contact point between the mat and said form band supported on said convex corresponding portion and ending at a transition point in the feed-in section, said length equalling a distance which, at said speed of said form bands, is traversed by the form bands over a time period during which the heat transmitted by the form bands has not yet reached an inner zone of the mat, the corresponding portion of the lower support plate forming the initial feeder segment and the lower support plate zone forming the feed-in section together form an inflexible unit, said inflexible unit being pivotable about a cross shaft disposed at an end of the feed-in section remote from the initial feeder segment, a perpendicular distance between the cross shaft and the upper support plate being adjustable.

2. The double-band press according to claim 1 wherein the curvature of the convex corresponding portion of the support plate is not substantially less than a radius of the corresponding guide drum.

3. The double-band press according to claim 1, further comprising a heating element heating at least one form band at a position immediately before the band enters the feed-in section.

4. The double-band press according to claim 2, further comprising a heating element heating at least one form band at a position immediately before the band enters the feed-in section.

5. The double-band press according to claim 1, further comprising a heat shield disposed between the lower run of an upper of said form bands and the feed tray, said heat shield deflecting away from the mat the radiant heat emanating from the upper form band before the mat makes contact therewith.

6. The double-band press according to claim 2, further comprising a heat shield disposed between the lower run of an upper of said form bands and the feed tray, said heat shield deflecting away from the mat the radiant heat emanating from the upper form band before the mat makes contact therewith.

7. The double-band press according to claim 3, further comprising a heat shield disposed between the lower run of an upper of said bands and the feed tray, said heat shield deflecting away from the mat the radiant heat emanating from the upper form band before the mat makes contact therewith.

8. The double-band press according to claim 1, wherein the feed tray is positioned so that the mat contacts both form bands at substantially the same time.

9. The double-band press according to claim 1, wherein a front edge of the feed tray nearest the initial feeder segment is adjustable in position.

10. The double-hand press according to claim 2, wherein a front edge of the feed tray nearest the initial feeder segment is adjustable in position.

11. The double-band press according to claim 8, wherein a front edge of the feed tray nearest the initial feeder segment is adjustable in position.

12. The double-band press according to claim 9, wherein the front edge of the feed tray is pivotable about a second cross shaft.

13. The double-band press according to claim 9, wherein the front edge of the feed tray can reciprocate back and forth along a direction parallel to the direction of movement of the form bands in the flat compression section.

* * * * *

UNITED STATES PATENT AND TRADEMARK OFFICE

CERTIFICATE OF CORRECTION

PATENT NO. : 5,112,209
DATED : May 12, 1992
INVENTOR(S) : Ahrweiler et al.

It is certified that error appears in the above-indentified patent and that said Letters Patent is hereby corrected as shown below:

In column 1, line 47, change "describes" to -- describes how --;

Column 2, line 16, change "corresponding" to -- correspondingly --;

Column 5, line 3, change "subjectd" to -- subjected --;

Column 8, line 14, change "achieved" to -- achieved by --;

Column 10, line 47, change "tghe" to -- the --;

Column 10, line 68, change ""2.5?" -- "2.5" --;

Column 12, line 45, change "said bands" to -- said form bands --.

Signed and Sealed this

Twenty-eight Day of March, 1995

*Attest:*

BRUCE LEHMAN

*Attesting Officer*

*Commissioner of Patents and Trademarks*